United States Patent [19]

Bourget

[11] 4,375,720

[45] Mar. 8, 1983

[54] METHOD OF END-TO-END CABLE JOINING FOR USE WITH SMALL DIAMETER, ARMORED CABLE HAVING COMPRESSED MINERAL INSULATION

[75] Inventor: Jean-Claude Bourget, Issy les Moulineaux, France

[73] Assignee: Les Cables de Lyon, Lyons, France

[21] Appl. No.: 280,583

[22] Filed: Jul. 6, 1981

[30] Foreign Application Priority Data

Jul. 4, 1980 [FR] France ..... 80 14919

[51] Int. Cl.[3] ..... H01R 43/00

[52] U.S. Cl. ..... 29/869; 174/88 R; 219/137 R

[58] Field of Search ..... 174/88 R, 84 R; 29/868, 29/869, 870, 871; 219/127, 60 R, 100, 58, 137 R

[56] References Cited

U.S. PATENT DOCUMENTS 2,393,935 1/1946 Scott ..... 174/84 R 3,903,595 9/1975 Takada et al. ..... 29/870

*Primary Examiner*—Francis S. Husar

*Assistant Examiner*—Linda McLaughlin

*Attorney, Agent, or Firm*—Sughrue, Mion, Zinn, Macpeak and Seas

[57] ABSTRACT

Cable ends (1 and 2) are to be joined. The cables are armored by stainless steel sheaths, and have two conductors (9 & 11, and 8 & 10 respectively) insulated by means of compressed mineral insulation (14). The cables are typically for thermocouples and have an outside diameter of a few millimeters. Joining proceeds as follows: The cable ends are reduced in diameter by swaging, e.g. with initial conical portions (5,4) followed by smaller diameter portions (7,6). The ends of the swaged portions are stripped to reveal the conductors which are joined end-to-end by welding. A longitudinally slotted length of tubing (3) is placed around the join, and the tubing is filled, via its slot, with powdered mineral insulation. The length of tubing 3 is then closed by welding, and the entire join is drawn down around the join to ensure that the entire joined cable is of uniform outside diameter.

3 Claims, 1 Drawing Figure

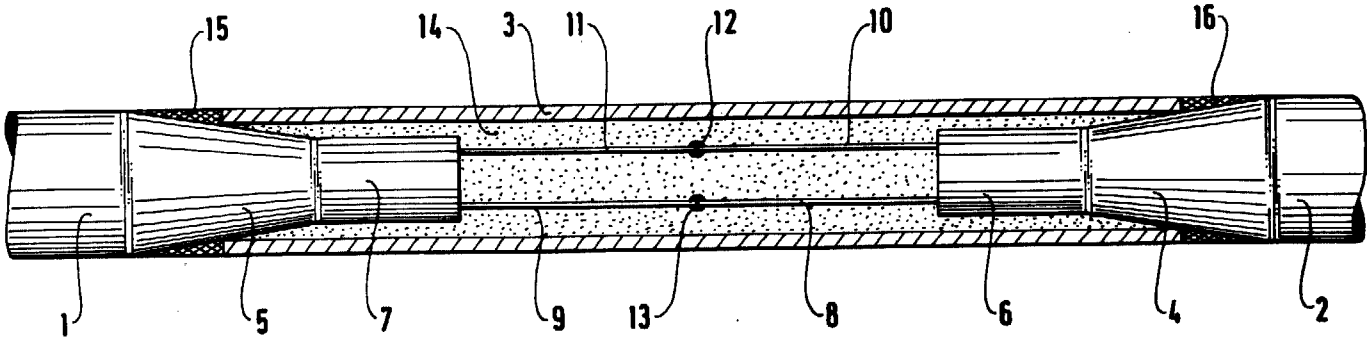
16
15
10
12
11
3
14
2
4
6
8
13
9
7
5
1

METHOD OF END-TO-END CABLE JOINING FOR USE WITH SMALL DIAMETER, ARMORED CABLE HAVING COMPRESSED MINERAL INSULATION

The present invention relates to a method of end-to-end cable joining for use with small diameter, armoured cable having compressed mineral insulation, e.g. thermocouple cable.

BACKGROUND OF THE INVENTION

When making an end-to-end join between two ends of armoured cable of this nature, and having an outside diameter of a few millimeters, welding the conductors and the sheaths together is a tricky operation that tends to leave a thickening at the join, however carefully or skilfully performed. Such a thickening is a hinderance to laying the cable and, in particular, there is a danger of it catching while the cable is being drawn through a tight space, with a consequential danger of the cable breaking at the join.

Preferred implementations of the present invention enable end-to-end welding of armoured cables that use compressed mineral insulation without producing a thickening at the join, while providing a join whose mechanical strength differs little from that of the rest of the cable. Further, the electric and dielectric characteristics of the cable are substantially unaltered at the join.

SUMMARY OF THE INVENTION

The present invention provides a method of end-to-end cable joining for use with small diameter, armoured cable having compressed mineral insulation, said method comprising the steps of:

(a) preparing a length of longitudinally slotted tubing made of the same metal as the cable armour sheath, and having a slightly larger outside diameter;

(b) swaging a portion of the sheath of each of the cable ends to be joined to reduce the outside diameter of said portion to less than the inside diameter of said length of tubing, said swaged portions each extending over a distance of slightly less than half the length of said length of slotted tubing;

(c) stripping the ends of the swaged portions of cable;

(d) welding together the ends of corresponding conductors as revealed by step (c);

(e) placing said slotted length of tubing around the ends of the cables as joined by step (d), and temporarily fixing it in place with a few tacking welds;

(f) filling the inside of said slotted tubing via its slot with powdered mineral insulation, thereby reconstituting the mineral insulation of the conductors therein;

(g) radially compressing said longitudinally slotted tubing to bring the edges of the slot together, and closing said slot by welding;

(h) permanently fixing the ends of said tubing to the sheaths of the cables by welding or brazing;

(i) filling in, by brazing, any discontinuities in the outer surface of the joined cables in the vicinity of the ends of said tubing; and (j) drawing out the cable around the joint to ensure a uniform outside diameter matching the outside diameter of the rest of the cable.

The welding operations are preferably performed by arc welding under an inert gas and without adding any metal to the parent members so joined.

The ends of the cables to be joined are preferably swaged in diameter in step (b) via a cone with a peak angle of about 20°.

BRIEF DESCRIPTION OF THE DRAWING

One particular implementation of a joining method in accordance with the present invention is described by way of example with reference to the sole FIGURE of the accompanying drawing. The FIGURE is a partial longitudinal section through the joined ends of a thermocouple cable sold by the assignees under the trade mark "Pyrotenax".

DETAILED DESCRIPTION

Two cables 1 and 2 are to be joined. They are both 3 mm in diameter and comprise a nickel-chrome alloy conductor, a nickel alloy conductor, a stainless steel sheath and mineral insulation made of magnesia.

In order to join the ends, a 20 mm length of longitudinally slotted tubing 3 is prepared with a slightly larger diameter than the cables, e.g. 4 mm. The slot (not shown) should be about 1 mm wide. Cable end portions 6,7 about 15 mm in total length are swaged to a diameter of about 1.6 mm with transition cones 4,5 having a peak angle of about 20°. The end portions are then stripped over about 5 mm to reveal the conductors. Corresponding thermocouple conductor ends 8, 9 and 10, 11 are then placed end-to-end in a welding jig (not shown), and are joined by arc welding under an inert gas using a tungsten electrode, and without adding any extra metal (welds 12 and 13).

Once the conductors are welded together, the length of slotted tubing 3 is placed over the join and is temporarily held in position by tacking welds at a few points. The same tungsten inert gas (T.I.G.) technique is be used for tacking. The mineral insulation 14 is then reconstituted in the region of the join by inserting mineral insulation powder through the slot. The tube 3 is filled in this manner. The slot is then closed by applying radial pressure to the length of tubing until the edges of the slot meet. The closure is made permanent by welding the edges together, again using the T.I.G. technique.

The ends of the tubing 3 are then finally connected to the cable sheaths by welding or by brazing, and in particular the interstices 15 and 16 are filled in by brazing.

Finally the cable around the join is drawn through a die to ensure uniform outside diameter over the join equal to the outside diameter of the rest of the cable.

Thermocouple cable joined in the manner described above has tested for tensile strength. It has been found that welding the ends of the tubing gives a join that is about 80% as strong as un-interrupted cable, while brazing the ends gives a join that is about 50% as strong.

Naturally the method described above can be modified to meet various requirements without thereby going beyond the scope of the invention claimed. In particular, other welding techniques such as arc welding with addition of extra metal, or oxy-acetylene welding can be used with cable sheaths made of metals suitable for such other techniques.

I claim:

1. A method of end-to-end cable joining for use with small diameter, armoured cable having compressed mineral insulation, said method comprising the steps of:

(a) preparing a length of longitudinally slotted tubing made of the same metal as the cable armour sheath, and having a slightly larger outside diameter;

(b) swaging a portion of the sheath of each of the cable ends to be joined to reduce the outside diameter of said portion to less than the inside diameter of said length of tubing, said swaged portions each extending over a distance of slightly less than half the length of said length of slotted tubing;

(c) stripping the ends of the swaged portions of cable;

(d) welding together the ends of corresponding conductors as revealed by step (c);

(e) placing said slotted length of tubing around the ends of the cables as joined by step (d), and temporarily fixing it in place with a few tacking welds;

(f) filling the inside of said slotted tubing via its slot with powdered mineral insulation, thereby reconstituting the mineral insulation of the conductors therein;

(g) radially compressing said longitudinally slotted tubing to bring the edges of the slot together, and closing said slot by welding;

(h) permanently fixing the ends of said tubing to the sheaths of the cables by welding or brazing;

(i) filling in, by brazing, any discontinuities in the outer surface of the joined cables in the vicinity of the ends of said tubing; and (j) drawing out the cable around the joint to ensure a uniform outside diameter matching the outside diameter of the rest of the cable.

2. A method according to claim 1, wherein the welding operations are performed by arc welding under an inert gas and without adding any metal to the parent members so joined.

3. A method according to claim 1 or 2, wherein the ends of the cables to be joined are swaged in diameter in step (b) via a cone with a peak angle of about 20°.

* * * * *